US011666135B2

(12) United States Patent
Dellwo

(10) Patent No.: US 11,666,135 B2
(45) Date of Patent: Jun. 6, 2023

(54) SMARTPHONE HOLSTER

(71) Applicant: Randy Dellwo, Bend, OR (US)

(72) Inventor: Randy Dellwo, Bend, OR (US)

( * ) Notice: Subject to any disclaimer, the term of this patent is extended or adjusted under 35 U.S.C. 154(b) by 0 days.

(21) Appl. No.: 16/918,959

(22) Filed: Jul. 1, 2020

(65) Prior Publication Data

US 2021/0000247 A1 Jan. 7, 2021

Related U.S. Application Data

(60) Provisional application No. 62/869,170, filed on Jul. 1, 2019.

(51) Int. Cl.
*A45F 5/02* (2006.01)
*A45C 11/00* (2006.01)

(52) U.S. Cl.
CPC ..... *A45F 5/021* (2013.01); *A45C 2011/002* (2013.01); *A45F 2005/023* (2013.01); *A45F 2200/0516* (2013.01)

(58) Field of Classification Search
CPC ..... A45F 5/021; A45F 2005/023; A45F 2200/0516; A45C 2011/002; Y10S 206/804; B65D 83/0005; B65D 83/087
USPC ..... 224/196, 242, 245, 677, 197; 206/804, 206/249, 320
See application file for complete search history.

(56) References Cited

U.S. PATENT DOCUMENTS 2,765,110 A * 10/1956 Wirth ..... A45F 5/02 224/675
3,244,981 A * 4/1966 Der Tatevasian ..... 343/702
4,166,557 A * 9/1979 Conley ..... A45C 1/04 224/663
4,775,083 A * 10/1988 Burger ..... A45F 5/02 224/675
4,942,617 A * 7/1990 Boylan ..... H04R 1/1033 381/384
5,353,956 A * 10/1994 Wilson ..... B65D 83/0005 426/115
5,452,829 A * 9/1995 King ..... G08B 3/1058 224/678
6,029,871 A * 2/2000 Park ..... A45F 5/021 224/666
6,176,401 B1 * 1/2001 Lim ..... G08B 3/1058 224/678
6,357,641 B1 * 3/2002 Cheng ..... A45C 13/10 224/678
7,690,541 B2 * 4/2010 Pellegrini ..... F41C 33/045 224/198
8,151,981 B2 * 4/2012 Nordstrom ..... A45C 11/00 206/254
2002/0100784 A1 * 8/2002 Baird ..... A45F 5/02 224/667
2010/0176174 A1 * 7/2010 Felts ..... F42B 39/02 224/676
2014/0263494 A1 * 9/2014 Treska ..... A45C 11/00 224/191

* cited by examiner

*Primary Examiner* — Adam J Waggenspack
(74) *Attorney, Agent, or Firm* — Donn K. Harms

(57) ABSTRACT

A smartphone holster is provided which is adapted for engagement to the belt or person of a user. A cavity within a housing of the holster is configured to hold a smartphone therein which may be inserted through an opening at a top end of the holster. Frictional contact by a flexible friction member within the cavity can aid in holding the phone therein. A curved lid may also be provided which is biased to position a curved portion over the opening to the cavity in which the phone is positioned.

13 Claims, 6 Drawing Sheets

SMARTPHONE HOLSTER

This application claims priority to U.S. Provisional Patent application Ser. No. 62/869,170 filed on Jul. 1, 2019, which is incorporated herein in its entirety by this reference thereto.

BACKGROUND OF THE INVENTION

1. Field of the Invention

The present invention relates to cellular phones and more recently, smartphones. More particularly, the invention relates to a belt-engageable holster to securely hold a smartphone which is configured to engage with a belt loop to prevent sliding and to impede or prevent communication of harmful RF energy from the holstered smartphone to the body of the user.

2. Prior Art

Modern cellular phones have evolved into smartphones which provide the user with a large LCD display on a front surface of the phone. Unfortunately, the large size and planar configuration of such smartphones, which make them user-friendly also render them hard to store, when not in use.

Users of such smartphones have thus resorted to sliding them in a purse or pants pocket where they are hard to retrieve or positioning them in a shirt pocket where they are prone to falling when the user is bending over. Additionally, even during storage, modern smartphones continue to employ and emit radio frequency (RF) energy because they are continuously contacting local cell towers to identify the presence of the phone and to allow the phone to download text messages and the like.

The device herein, described and disclosed, provides a light weight holster adapted for engagement with a wide variety of smartphones. The housing features opposing recesses or notches allowing for easy grasping of the smartphone when needed, but also allowing a full insertion of the smartphone within a cavity of the housing, to thereby protect the easily-scratched screen.

The forgoing examples of related art and limitations related therewith are intended to be illustrative and not exclusive, and they do not imply any limitations on the holster device herein adapted for secure storage of a smartphone. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art of secure by accessible storage of smartphones. It achieves the above noted goals through the provision of a belt-engageable holster providing secure and convenient ongoing storage of the smartphone on the person of the user.

The disclosed device in all modes features a housing having an internal cavity adapted to hold a smartphone therein. The cavity provided may be sufficiently deep to allow full coverage of the LCD screen of the smartphone when stowed. While such full coverage would normally cause a problem for the user trying to remove the smartphone from the cavity of the housing, the device herein includes opposing notches formed into the front wall at a cavity-surrounding upper edge of the housing. These notches provide the user grip points for the thumb and finger on opposing corners of the smartphone, to allow for easy removal, and insertion of their smartphone into the cavity of the housing of the holster.

The cavity holding the stowed smartphone is preferably lined with felt or a similar soft compressible material to provide a non scratching contact with both sides of the smartphone during storage, insertion, and removal. This insures that even such smartphones with easily scratched LCD screens are maintained scratch free.

Further, with the compressible soft material in frictional contact with the smartphone, and with the smartphone completely engaged within the holster cavity but for corners thereof, it is virtually impossible for the smartphone to accidentally fall from the holster. In some modes it is preferable to line the cavity with soft material which will expand to form the cavity slightly smaller than the smartphone. Such may be foam, felt, covered-foam, memory foam, or other material which will compact upon the force of the phone being inserted. When inserted, the compressible material will move toward its enlarged position and will thereafter impart a biasing contact to the inserted smartphone to securely hold it in the cavity. Without the included opposing notches such biased contact would not be employable or at best would render the smartphone hard to remove.

The housing may be formed of wood or a stiff polymeric material to provide a cavity for storage which will always maintain its dimensions. Such insures that the stowed smartphone is not damaged if the holster housing is impacted by force which would normally bend a flexible housing.

In a preferred mode of the device, an RF blocking layer surrounds the cavity of the holster housing. Such may be a copper or other RF blocking mesh which will allow communication from a cell tower to the stowed smartphone, but is positioned on the housing to block communication of RF to the body of the user.

Additionally preferred is a belt-engageable strap to hold the holster housing on the belt of a user where it is easily employed. Particularly preferred is a configuration of the belt which allows for positioning of a pant belt loop within a recess of the strap. This positioning uses the belt loop engaged in the recess as an anchor. So anchored, the holster is prevented from detaching from the belt of the user and it thus remains in a fixed position on the belt during use.

Apertures formed in the side or bottom wall of the holster housing provide communication paths for the microphone and speaker on the holstered smartphone. These apertures may be formed as "knock out" components to allow a single holster housing to be configured for multiple smartphones.

With respect to the above description, before explaining at least one preferred embodiment of the herein disclosed smartphone holster device in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other components configured to holster a smartphone and for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. Finally, unless provided with a different respective definition, the term substantially herein means plus or minus five percent.

It is an object of this invention to provide a smartphone holster which is easily engaged to a belt of a user.

It is an additional object of this invention to provide such a smartphone holster which is configured to provide both a secure holster for a smartphone and for the easy and quick insertion and removal of any smartphone, so holstered.

These and other objects of the invention will be brought out in the following part of the specification, wherein detailed description is for the purpose of fully disclosing the invention without placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings.

DETAILED DESCRIPTION OF THE PREFERRED

Embodiments of the Invention

Figure 1:
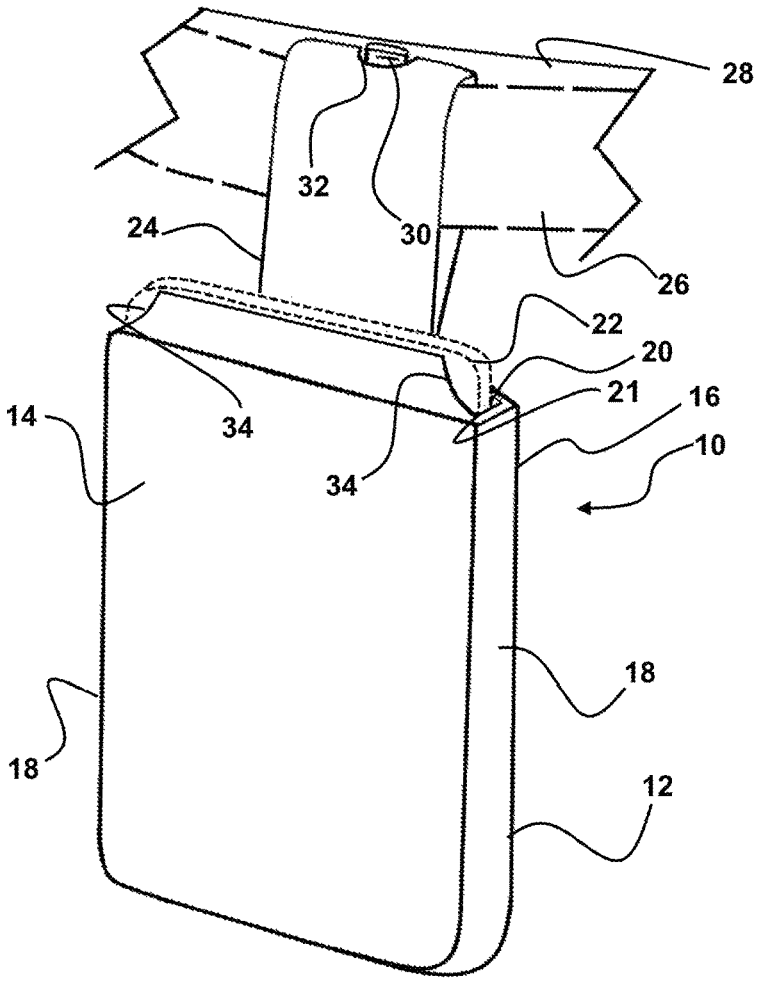
FIG. 1 is a perspective view of the smartphone holster device showing the housing having a cavity covering substantially the exposed surfaces of a smartphone where the housing is engaged to the belt worn by a user.

In this description, the directional prepositions of up, upwardly, down, downwardly, front, back, top, upper, bottom, lower, left, right and other such terms refer to the device as it is oriented and appears in the drawings and are used for convenience only. They are not intended to be limiting or to imply that the device has to be used or positioned in any particular orientation.

Now referring to drawings in FIGS. 1-12, wherein similar components are identified by like reference numerals, there is seen in FIG. 1 a perspective view of the smartphone holster device 10. As shown, the device 10 has a housing 12 having a front wall 14, rear wall 16 and two side walls 18.

A cavity 20 within the housing 12, in between the front wall 14, rear wall 16, and sidewalls 18, is preferably formed in a size adapted for insertion of a smartphone 22 therein through an opening 21 communicating with the cavity 20. Preferably, the entire front and rear surface of the smartphone 22, once inserted within the cavity 20, are protected. The cavity 22 is preferably lined with a soft and compressible material such as felt or foam or the like, which will compress on smartphone insertion but expand after such insertion as one mode to provide a biased contact against contacting exterior surfaces of the inserted smartphone 22.

Additionally shown in FIG. 1, in one preferred mode, a strap 24 is engaged with the housing 12 to provide a connector to the person of the user. The strap 24, so engaged, is adapted to encircle a belt 26 of a user such as belts 26 engaged to pants 28 through belt loops 30. As shown, the strap 24 is engaged around the belt 26 with the belt loop 30 positioned within a strap opening 32 formed into the strap 24. As noted below, the strap 24 may be in sections which are removably engaged at one end thereof to the housing to allow for such a belt 26 and belt loop 30 engagement which anchors the device 10 in position on the belt 26.

Also depicted in an as used position, shown in FIG. 1 of the device 10, are opposing notches 34 formed into at least the front wall 14 at an upper edge of the housing 12 adjacent the opening 21 providing a path into and out of the cavity 20. The notches are positioned at opposing sides of the front wall 14 where it intersects with the opposing sidewalls 18, and so positioned, form part of the edge of the opening 21. The positioning of the notches 34 are preferred, as noted, as these notches 34 expose opposing corners of the proximal end of the smartphone 22 when it is fully inserted into the cavity 20. In use, the user will employ their thumb and opposing finger to grip on the exposed opposing corners of the smartphone located within the notches 34 to remove the smartphone 22 from the cavity 20.

The notches may be employed in all modes of the device 10 herein disclosed and are formed by at least removing sections from the front wall 14 and the opposing two sidewalls 18, at the intersections of the frontwall 14 with the sidewalls 18, to thereby expose corner portions of an inserted phone 22. Sections may also be removed from the rear wall 16 adjacent the intersection with the sidewalls 18 to increase the ease of use in gripping the phone corners to remove it. Thus formed, notches 18 will extend from the top edge of the opening 21 of a portion of the front wall 14 to a top edge of each sidewall 18 which will be formed shorter in length than the adjacent frontwall 14. If notches are formed also in the rearwall 16 they would mirror the shape of the notches 34 in the front wall 14, and the rear wall 16 will extend higher than the two sidewalls 18.

Figure 2:
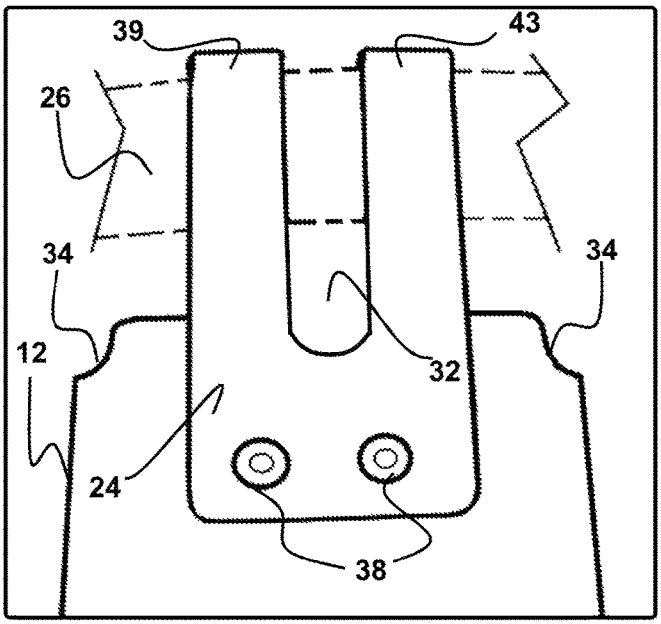
FIG. 2 shows a view of a rear side of the housing of figure one and depicts the belt engaged to the housing of the holster secured around the belt of the clothing of a user.

In FIG. 2 is shown a view of the rear wall 16 of the housing 12 such as in FIG. 1. Also shown are the strap 24 secured in an encircled engagement around the belt 26 worn by the user. The strap opening 32 is shown formed in the strap 24 and adapted to engage a belt loop 30 of the user as depicted in FIG. 1. The notches 34 are shown formed into the front wall 14, rear wall 18 and extend to the shorter opposing sidewalls 18, defining the opening 21 to the cavity 20. Removably engageable fasteners 38 on the housing 12 and the strap 24 may be employed to allow for removable engagement of the distal end of the strap 24 to the housing 12 after the strap 24 is encircled around the belt 26 of the user. This configuration will also allow connectors other than the strap 24 to be engaged to the housing 12 to hold it to a person or to something carried by the person such as a purse.

Figure 3:
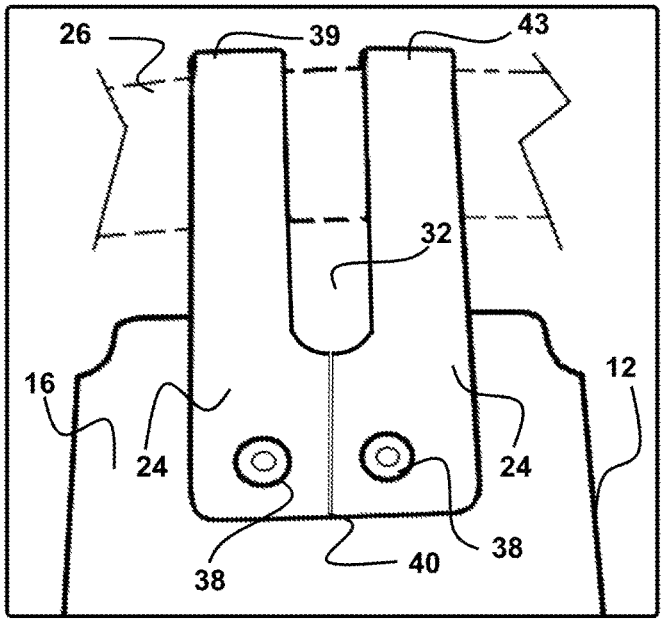
FIG. 3 depicts another view of the rear side of a housing of the device herein showing the strap formed in two halves thereby allowing engagement of the strap with a belt with concurrent positioning of a belt loop within the recess.

FIG. 3 depicts another view of the rear wall 18 of a housing 12 of the device herein showing the strap 24 formed with a separation 40 defining a gap between two halves of the strap 24 which are independently engageable around a belt 26 of the user. This mode of the device 10 with sectional strap 24 allows for engagement of the strap 24 around a belt 26 while buckled and on the person of the user. Further, it allows for engagement of the strap 24 around the belt 26 with a positioning of a first section 39 of the strap 24 on one side of a belt loop 30 and the second section 43 of the strap 24 engaged around a belt 26 on the opposite side of the belt loop 30. The belt loop 30 is thereby removably positioned within the slot or strap opening 32 and prevents sliding of the belt 26 and the device 10 upon the belt 26 during use.

Of course, it should be noted that while the strap 24 is shown herein with the distal end removably engaged to the housing 12 with fasteners 38, to allow for the engagement of other connectors and to allow a threading of the strap 24 around a belt 26 already buckled upon the person of the user, the strap 24 can be permanently engaged to the housing 12 and the belt 26 threaded through it prior to the user buckling the belt 26.

Figure 4:
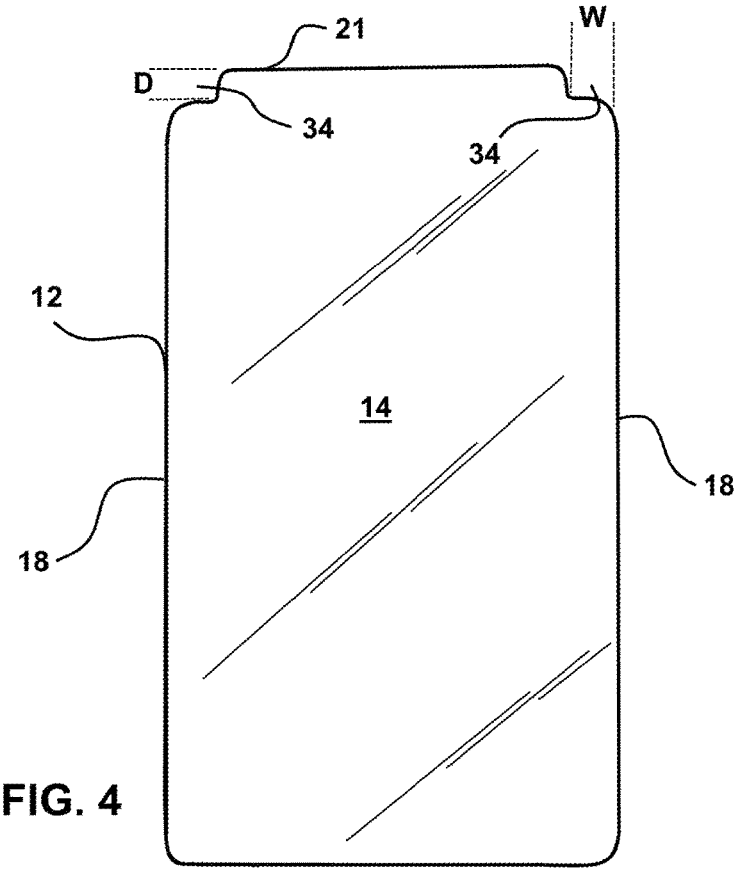
FIG. 4 depicts the holster housing showing the notches formed on opposing sides thereof adjacent the opening to the cavity of the housing and showing a width W and depth D thereof.

In FIG. 4 is shown the holster housing 12 with the notches 34 formed into the front wall 14 optionally in the rear wall 16, and with the sidewalls formed in a length from the bottom wall 41 to the opening 21 in a distance shorter than that of the front wall 14. As noted, the edges of the front wall 14 and rear wall 16 and sidewalls 18 will also define the shape and size of the opening 21 to the cavity 20 within the housing 12. As also noted, the notches 34 are sized and positioned to expose corner areas of the proximal end of the inserted smartphone 22 fully recessed into the cavity 20 to allow for easy removal of the smartphone 22, when holstered, by gripping opposing corners of the proximal end of the smartphone 22. Currently, a preferred sizing of the notches employs a width W extending inward from the sidewall 18 of ¼" to 1". The current favored sizing of the height H of the notches 34 is from ⅛" to ¾" above the end of the sidewall 18 at the opening 21. Thus, the cut out portion of the front wall 14 forming a notch 34 would have the front wall 14 at the opening 21 being ⅛" to ¾" taller than the side wall 18 at the opening 21.

Figure 5:
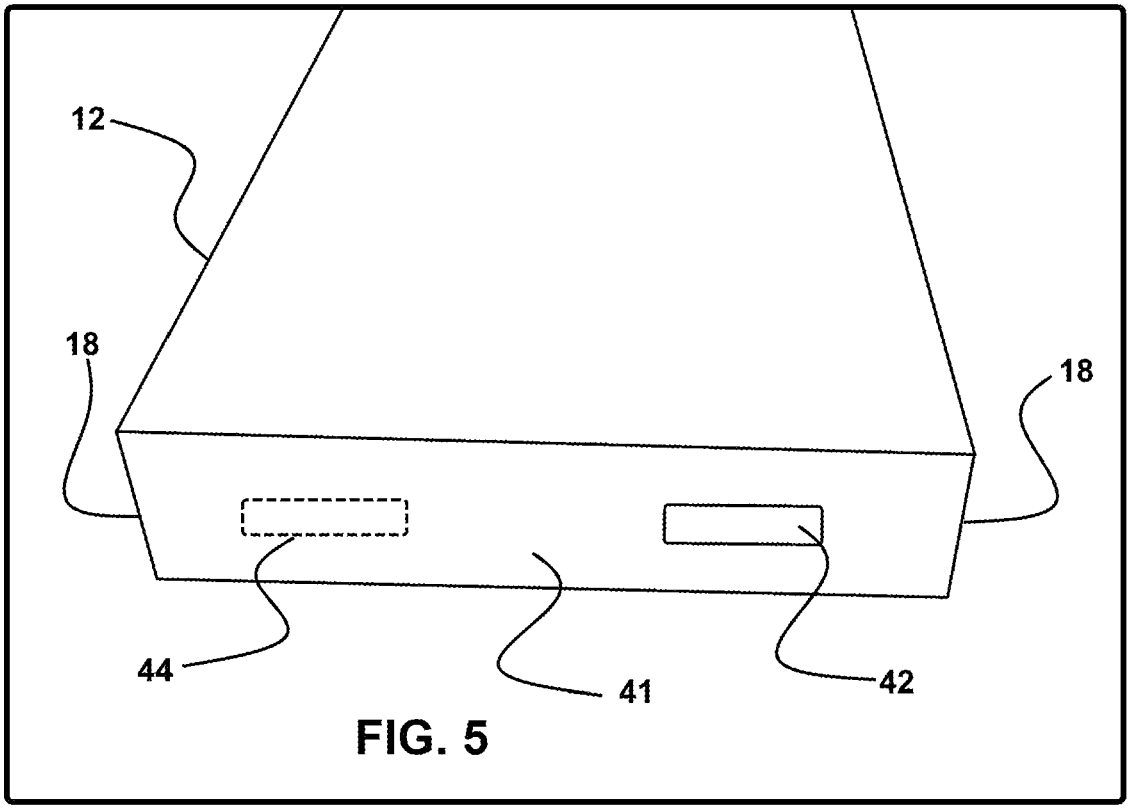
FIG. 5 depicts the holster housing having openings positioned therein to align with holstered-phone components such as the microphone or speaker.

Shown in FIG. 5 are preferred openings 42 which are located on the bottom wall 41 of the housing 12. The openings 42 can be fixed in position from the factory or they may be "knock out" openings 44 formed in one or a plurality of locations which correlate to the speaker and/or microphone on the phone.

Figure 6:
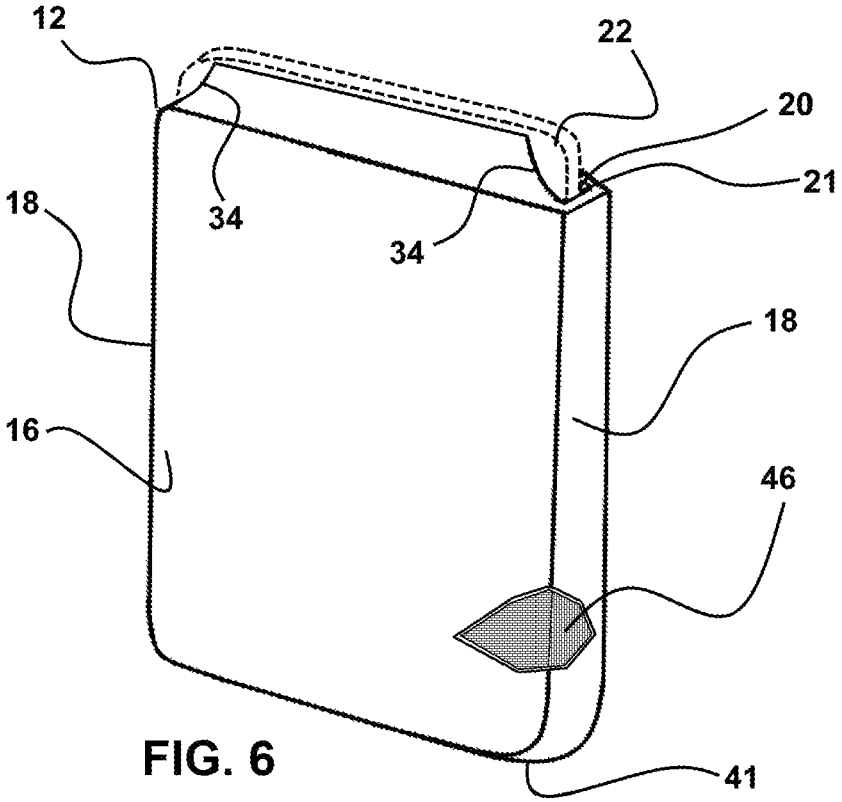
FIG. 6 depicts another mode of the holster housing having an RF blocking layer located on the rear side of the housing and preferably the opposing sidewalls.

Depicted in FIG. 6 is a mode of the holster device 10 housing 12 which includes an RF blocking layer 46. The RF blocking layer 46 may be included in any mode of the device 10 herein to inhibit or block RF radiation from reaching the body of the user. This RF blocking layer 46 can be positioned on the sidewalls 18, rear wall 16, and bottom wall 41. Preferably, all or at least a portion of the front wall 14 may remain unscreened to allow the smartphone to communicate with the cellular system unimpeded. The RF blocking layer is formed of metal foil or material which will absorb and block RF energy such as for example lead foil or aluminum foil material.

Figure 7:
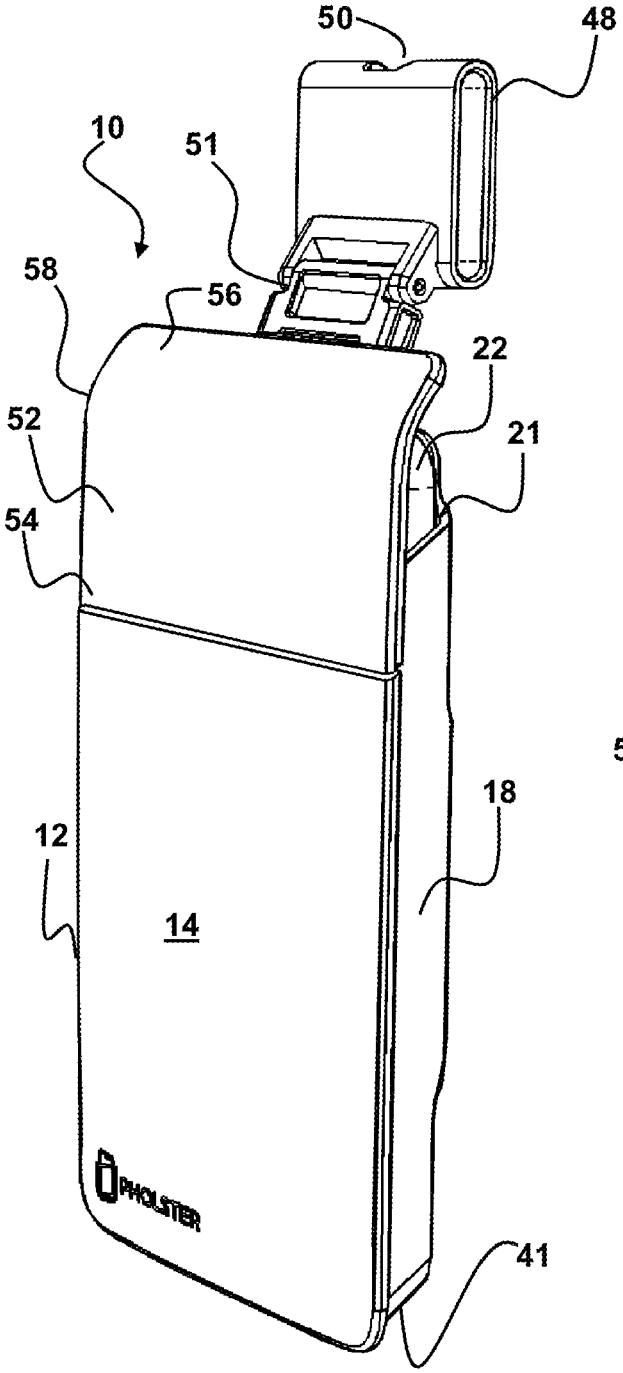
FIG. 7 depicts a side perspective view of a preferred mode of the disclosed device having a hinged or pivoting belt connecter and having a biased curved cover shown in a first position, where a curved second end covers and protects a protruding end of the housed phone and concurrently maintains it within the holster during movement of the user.
Figure 8:
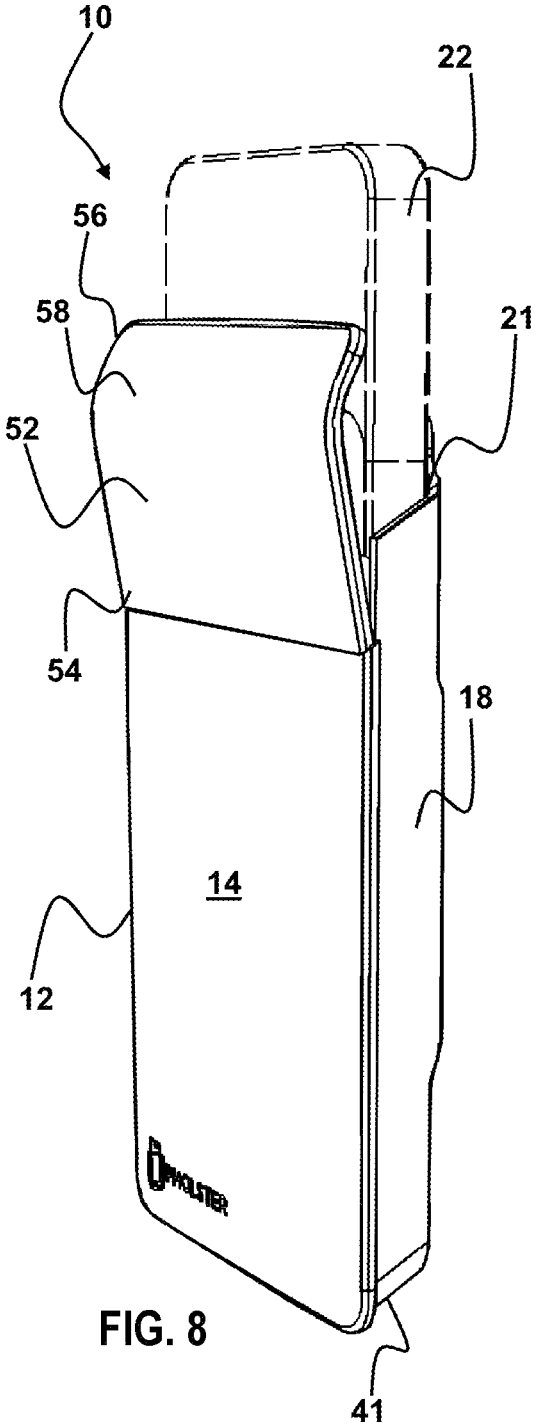
FIG. 8 shows the device as in FIG. 7, depicting a curved cover in a second or retracted position, allowing for the insertion or removal of the housed phone into the holster cavity and past the curved portion of the biased curved cover.

Shown in FIGS. 7-8 are side perspective views of another particularly preferred mode of the disclosed device 10. As shown, the device 10, in this mode, includes a belt connector 48 having a passage communicating therethrough which is configured for a sliding engagement upon a belt 26 of the user. This belt connector 48 preferably includes a connector opening 50 communicating with the passage through the belt connector 48 which is configured to engage a belt loop 30 as in FIG. 1. The belt connector 48 is engaged to the housing 12 as shown by a pivoting connector 51. By pivoting connector 51 is meant that the housing 12 will rotate on a hinge or other pivoting engagement connecting the housing 12 to the belt connector 48.

Additionally included on the housing 12 is a curved cover 52 which is in a pivoting engagement to the housing 12 at a substantially planar first end 54 of the curved cover 52. This pivoting engagement may be with a hinge or other such rotating engagement, such as with a pin 55 (FIG. 10) rotationally engaged in a slot 57 (FIG. 11) within the cavity 20 or other rotating engagement positioned at or adjacent the first end 54 of the curved cover 52.

A second end 56 of the curved cover 52 curves or angles in a direction to position a curving section 58 of the curved cover 52, covering the opening 21 to the cavity 20 of the housing 12, when the curved cover 52 biases to the first position shown in FIG. 7. The curved cover 52 is biased to maintain this first position unless forced toward and to the second position of FIG. 8 by a user. Biasing members 60 (FIG. 10) maintain the curved cover 52 in the first position to cover the opening 21 to the cavity 20 and the pathway to remove the phone 22 from the cavity 20 through the opening 21 to prevent the phone 22 from exiting the holster 12. In experimentation, this positioning of the biased cover 52 to position the curved section 58 over the opening 21 significantly enhanced the ability of the device 10 to hold the phone 22 within the cavity 20 during jarring motions of the user such as jumping and landing or moving their hips in a jarring fast manner.

Shown in FIG. 8 is the device 10 as in FIG. 7 but with the curved cover in a second position, pivoted in a direction away from the opening 21. In this second position, the curved cover 52 has been rotated on its pivoting engagement to the housing 12 by force of the hand of the user either pulling on the corners of the phone 22 or pushing on the second end 56 of the curved cover 52, or both. In this second position the curved section 58 is rotated out of the way of the opening 21 such that the phone 22 may be inserted into the cavity 20 through the opening 21 or removed therefrom.

Figure 9:
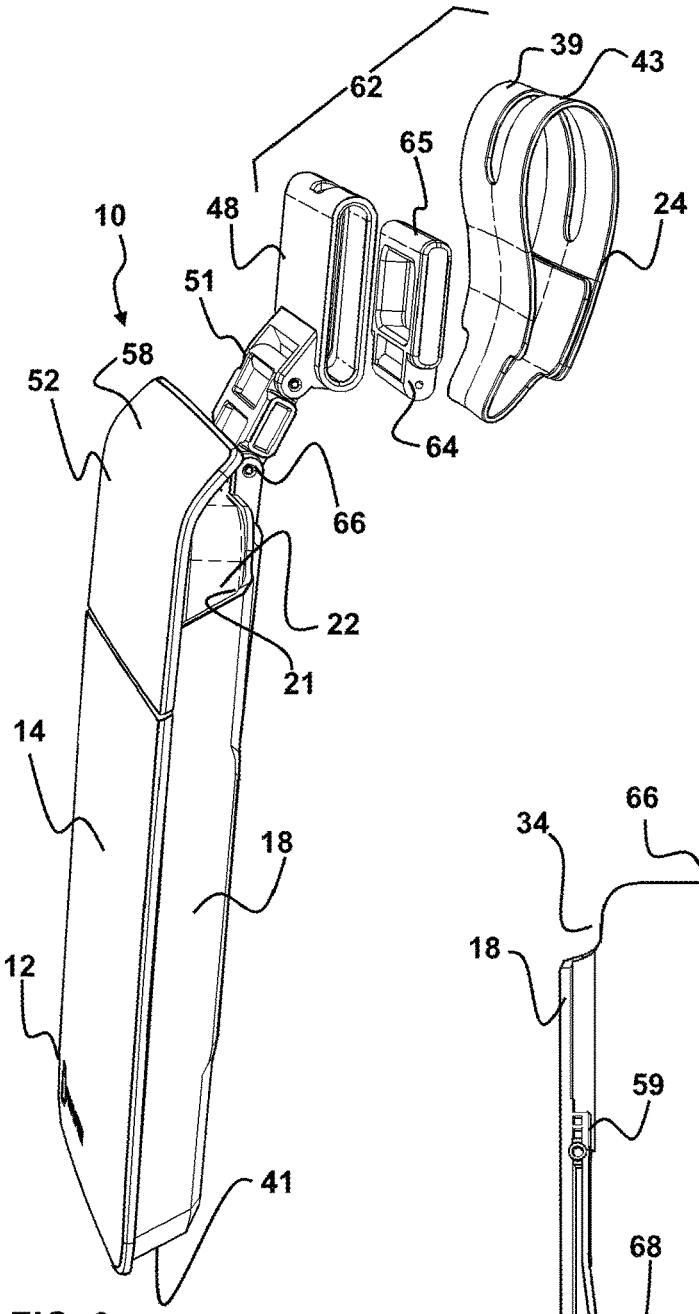
FIG. 9 shows the device as in FIG. 7-8 but with a kit of user engageable belt or purse connectors.

As noted, depicted in FIG. 9, is the device 10 as in FIGS. 7-8, but with a provided kit of user-engageable connectors enabling the user to choose a connector to engage the housing 12 to a chosen belt or purse. The kit 62 will be provided with a plurality of connectors, including a strap 24 connector, a ring 64 with a pivoting end 65 which is biased closed such as a carabiner, and the belt connector 48. Each of the kit members is configured at an engagement end to connect to a mount 66 on the housing 12 defining the phone holster. This kit 62 will allow the user to choose the connector appropriate to the engagement of the housing 12 to their person, clothing, or purse or the like.

Figure 10:
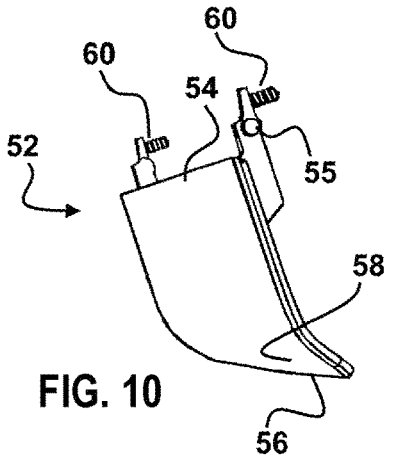
FIG. 10 depicts the cover showing biasing components thereon such as springs or members.

Shown in FIG. 10, is the curved cover 52 of the device 10 which functions as noted above. As shown, one or a plurality of biasing members 60 are connected to bias the curved cover 52 to the first position of FIG. 7, at all times, unless rotated to the second position of FIG. 8, by the hand of the user. A pivoting engagement of the first end 54 to the housing 12 may be accomplished with the depicted pin 55 which engages in a pivot slot 59 (FIG. 11) on the housing 12. This pivoting engagement and the biasing members maintain the curved cover 52 to a default first position shown in FIG. 9, which prevents removal of the phone 22 from the cavity 20 by positioning the curving section 58 to cover the opening 21 and block the pathway to remove the phone 22 from the cavity 20 through the opening 21.

Figure 11:
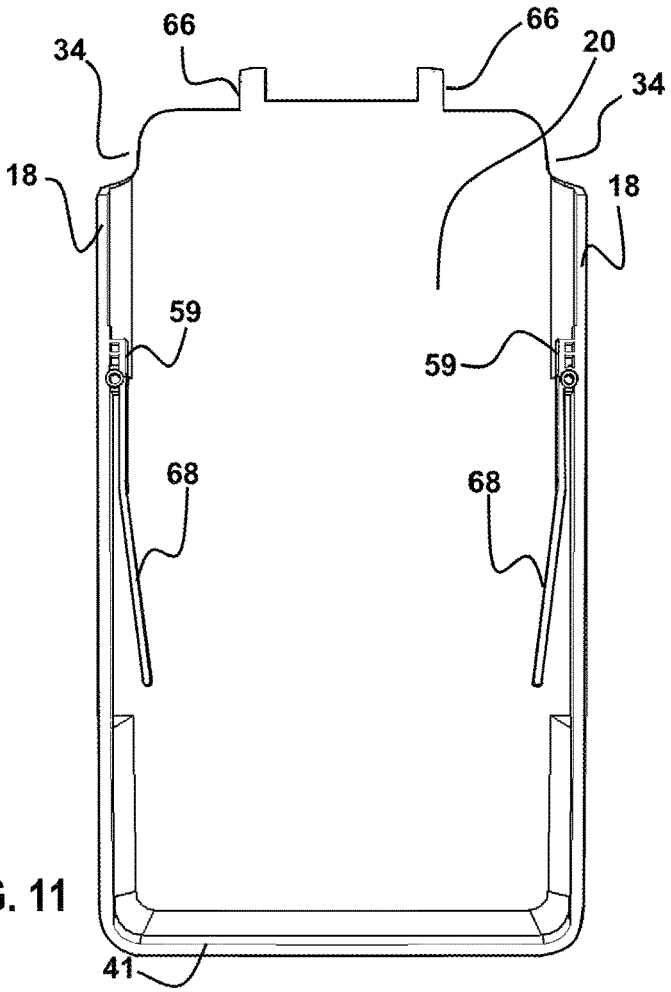
FIG. 11 is a sectional view through a preferred mode of the holster showing opposing biasing members on opposite sides which contact side surfaces of an inserted phone.

Shown in FIG. 11 is a sectional view of the housing 12 showing a preferred mode of the holster device 10 which may be employed in all modes herein. As shown, at least one and preferably a pair of friction members 68 may be positioned within the cavity 20 in locations to project from the interior of the sidewalls 18 into the cavity 20. These friction members 68 are flexible and will move toward the sidewall 18 when the phone 22 is slid into the cavity 20 and contact points on the surface of the phone 22 contact with the friction members 68. The biased force of the friction members 68 in contact with sides of the phone 22, provide for a biased frictional engagement of the phone 22 within the cavity 20, which will help hold the phone 22 therein, during jolting movements. The friction members 68 may be formed of material rendering them flexible but elastic in that they will be biased to return to their original shape and position, if deflected. Such material may be metal, fiberglass, polymeric material, or other material which has the flexible and elastic memory appropriate to deflect and impart biased contact against side edges of a phone 22 inserted into the cavity 20.

Figure 12:
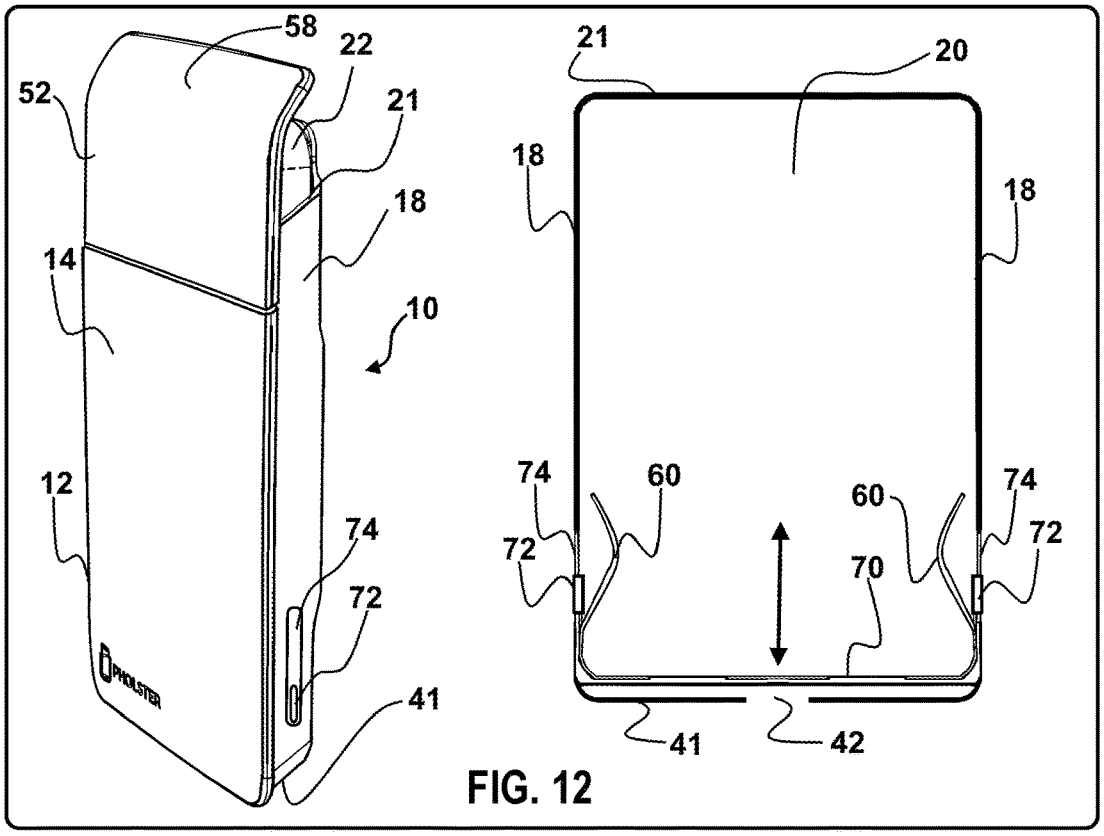
FIG. 12 shows a perspective view of the holster depicting a sliding secondary wall positioned within the cavity of the housing which is in a recessed position and which can be moved toward the opening by a slide adjuster positioned within guide slots in one or both sidewalls of the housing.

In FIG. 12 is shown a perspective view of the holster device 10 herein, adjacent a sectional view of the housing 12. As shown the housing 12 has a secondary wall 70 operatively engaged in a sliding engagement within the cavity 20 of the housing 12. Biasing members 60 may be connected to the secondary wall 70 and will slide with it during any such translation within the cavity 20.

As also shown in FIG. 12, this secondary wall 70 is in a recessed position in contact with or adjacent the bottom wall 41 of the housing 12. By adjacent is meant a position closest to the bottom wall 41 or between 0.10 inches to 0.75 inches away from the bottom wall 41. The secondary wall 70 in this sliding engagement within the cavity 20 can be moved by the user to a raised position shown in FIG. 13, by operation of one or two slide adjusters 72 which are connected to the secondary wall 70. These slide adjusters 72 are positioned within adjuster slots 74 formed through the sidewalls 18, such that the user may contact the slide adjusters 72 with a finger and translate them within the adjuster slots 74.

The length of the adjuster slots 74 provide a limit to the sliding movement of the secondary wall 70 within the cavity 20 toward and away from both the opening 21 and bottom wall 41, since the slide adjusters 72 will contact the sidewall 18 at each end of each respective adjuster slot 74. Further, with the slide adjusters 72 connected to the secondary wall 70, their engagement within the adjuster slots 74 provide a track for the secondary wall to slide upon during sliding movements within the cavity 20.

Figure 13:
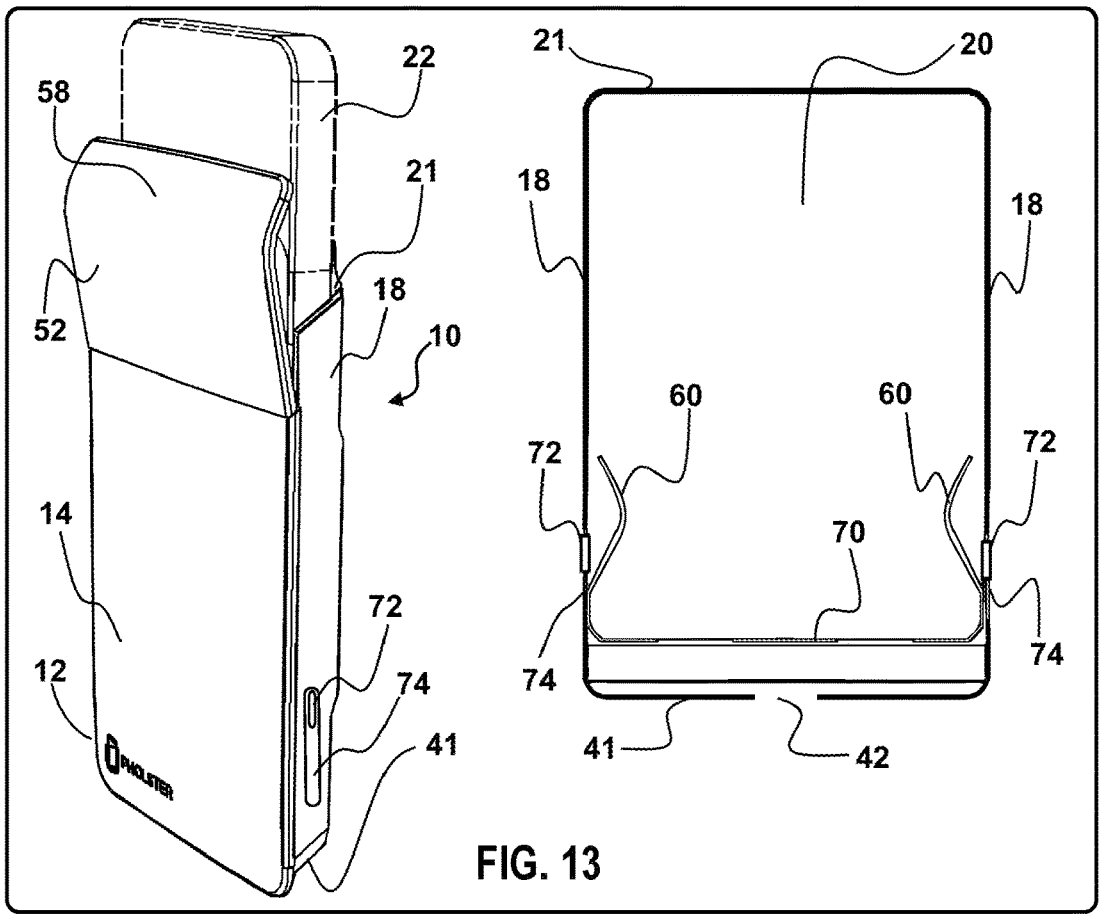
FIG. 13 shows the sliding secondary wall positioned in the raised position where it will raise the phone which is engaged at a lower end between the biasing members of the secondary wall, to position a proximal portion of the phone projecting from the opening for easy grasping.

Shown in FIG. 13 is a perspective view of the holster device 10 adjacent a sectional view through the housing 12 which depicts the secondary wall 70 moved to the raised position by a sliding of the slide adjusters 72 located within the adjuster slots 74 in a direction toward the opening 21 to the cavity 20. By raised position is meant that the secondary wall 70 has been moved within the cavity 20 in a direction toward the opening 21, a distance which will cause a portion of the proximal end of a phone 22 positioned in the cavity 20 to project from the opening 21. By a portion of the proximal end projecting is meant a length of the proximal end at least ¼ inch in length.

The user by sliding the slide adjusters 72 may thus move the secondary wall 70 and the biasing members 60, engaged therewith, upward and toward the opening 21 to thereby move a proximal end of a phone 22 positioned within the cavity as shown in FIG. 13, to a position having a portion of the proximal end projecting from the opening 21. The movement of the slide adjuster 72 by the force of the user thereon, also will overcome the biased closure of the curved cover 52 which is contacted by the proximal end of the phone 22 as it slides toward and out of the opening 21. The curved section 58 of the curved cover 52 is particularly preferred in this mode of the device 10 in that on a rear side surface facing the cavity 20, it forms a ramp which is contacted by the proximal end of the phone 22 to more easily rotate the curved cover 52 to the second or open position shown in FIGS. 8 and 13. This curved cover 52 also leaves the notches 34 exposed to allow the user to grip opposing ends of the proximal end of the phone 22 while located in the cavity 20, to pull it from the cavity 20 and concurrently rotate the curved cover 52 to the second or open position of FIG. 8.

While all of the fundamental characteristics and features of the smart phone holster device have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are considered included within the scope of the invention as defined by the following claims.

What is claimed is:

1. A smartphone holster adapted for engagement to the belt or person of a user, comprising:

a housing, said housing having a front wall connected to a rear wall by a pair of opposing sidewalls;

a cavity defined by an area between said front wall, said rear wall, and said opposing sidewalls;

an opening at an upper end of said housing communicating with said cavity;

a bottom wall at a lower end of said housing, opposite said opening;

said cavity configured for positioning of a smartphone therein by a sliding of said smartphone through said opening into said cavity;

a first notch formed into a first of said pair of sidewalls, at an intersection thereof with said opening;

a second notch formed into a second of said pair of sidewalls at an intersection thereof with said opening;

a curved plate defining a cover, said curved plate having a first end and having a second end and having opposing side edges extending between said first end and said second end;

said first end of said curved plate in a pivoting engagement to said housing;

a curved section of said curved plate extending from a central area thereof, between said first end and said second end thereof, to said second end thereof;

said curved plate biased to a first position wherein said curved section covers substantially all of said opening;

said curved plate rotatable to a second position having said opening uncovered;

said first notch and said second notch positioned for exposing opposing corners of said smartphone positioned within said cavity with said curved plate in said first position;

said curved section configured for contacting against said smartphone positioned within said cavity, wherein said curved plate is rotated to said second position during removal of said smartphone from said cavity by a user gripping said opposing corners of said smartphone through said first notch and second notch;

a connector in an engagement to said housing at an engagement end thereof; and said connector having a connector passage configured for an engagement with a belt or purse of a user, whereby a smartphone of a user may be holstered within said cavity of said housing, and carried by said user while in said engagement with said belt or purse.

2. The smartphone holster of claim 1, additionally comprising:

said connector having a connector opening in a sidewall thereof, said connector opening communicating with said connector passage; and said connector opening positioned to engage with a belt loop of the clothing of a user.

3. The smartphone holster of claim 1, additionally comprising:

said engagement of said connector to said housing being a pivoting connection of said engagement end thereof to said housing.

4. The smartphone holster of claim 1, additionally comprising:

a biasing member continuously urging said curved plate to said first position.

5. The smartphone holster of claim 2, additionally comprising:

a biasing member continuously urging said curved plate to said first position.

6. The smartphone holster of claim 3, additionally comprising:

a biasing member continuously urging said curved plate to said first position.

7. The smartphone holster of claim 1, additionally comprising:

at least one friction member positioned within said cavity in a connection to one of said pair of opposing sidewalls; and said friction member having a portion thereof for forming a biased contact against a surface of a smartphone positioned within said cavity with said friction member located between said surface of said smartphone and said one of said pair of opposing sidewalls.

8. The smartphone holster of claim 2, additionally comprising:

at least one friction member positioned within said cavity in a connection to one of said pair of opposing sidewalls; and said friction member having a portion thereof for forming a biased contact against a surface of a smartphone positioned within said cavity with said friction member located between said surface of said smartphone and said one of said pair of opposing sidewalls.

9. The smartphone holster of claim 3, additionally comprising:

at least one friction member positioned within said cavity in a connection to one of said pair of opposing sidewalls; and said friction member having a portion thereof for forming a biased contact against a surface of a smartphone positioned within said cavity with said friction member located between said surface of said smartphone and said one of said pair of opposing sidewalls.

10. The smartphone holster of claim 1, additionally comprising:

a secondary wall in-between said opening and said bottom wall, said secondary wall in a sliding engagement within said cavity;

said secondary wall slidable between a recessed position a first distance from said bottom wall and a raised position a second distance from said bottom wall which is larger than said first distance;

a slide adjuster connected to said secondary wall;

said secondary wall moveable between said recessed position and said raised position by a sliding of said slide adjuster; and whereby opposing corners of said smartphone are positionable to project from said opening by moving said slide adjuster to position said secondary wall to said raised position.

11. The smartphone holster of claim 2, additionally comprising:

a secondary wall in-between said opening and said bottom wall, said secondary wall in a sliding engagement within said cavity;

said secondary wall slidable between a recessed position a first distance from said bottom wall and a raised position a second distance from said bottom wall which is larger than said first distance;

a slide adjuster connected to said secondary wall;

said secondary wall moveable between said recessed position and said raised position by a sliding of said slide adjuster; and whereby said opposing corners of said smartphone are positionable to a respective alignment with said first notch and said second notch by moving said slide adjuster to position said secondary wall to said raised position.

12. The smartphone holster of claim 3, additionally comprising:

a secondary wall in-between said opening and said bottom wall, said secondary wall in a sliding engagement within said cavity;

said secondary wall slidable between a recessed position a first distance from said bottom wall and a raised position a second distance from said bottom wall which is larger than said first distance;

a slide adjuster connected to said secondary wall;

said secondary wall moveable between said recessed position and said raised position by a sliding of said slide adjuster; and whereby said opposing corners of said smartphone are positionable to a respective alignment with said first notch and said second notch by moving said slide adjuster to position said secondary wall to said raised position.

13. The smartphone holster of claim 7, additionally comprising:

a secondary wall in-between said opening and said bottom wall, said secondary wall in a sliding engagement within said cavity;

said secondary wall slidable between a recessed position a first distance from said bottom wall and a raised position a second distance from said bottom wall which is larger than said first distance;

a slide adjuster connected to said secondary wall;

said secondary wall moveable between said recessed position and said raised position by a sliding of said slide adjuster; and whereby said opposing corners of said smartphone are positionable to a respective alignment with said first notch and said second notch by moving said slide adjuster to position said secondary wall to said raised position.

* * * * *